US006842148B2

(12) United States Patent
Hendler et al.

(10) Patent No.: US 6,842,148 B2
(45) Date of Patent: Jan. 11, 2005

(54) FABRICATION METHOD AND APPARATUS FOR ANTENNA STRUCTURES IN WIRELESS COMMUNICATIONS DEVICES

(75) Inventors: Jason M. Hendler, Melbourne, FL (US); Floyd A. Asbury, Granger, IN (US); Frank M. Caimi, Vero Beach, FL (US); Michael H. Thursby, Palm Bay, FL (US); Kerry L. Greer, Melbourne Beach, FL (US)

(73) Assignee: SkyCross, Inc., Melbourne, FL (US)

( * ) Notice: Subject to any disclaimer, the term of this patent is extended or adjusted under 35 U.S.C. 154(b) by 7 days.

(21) Appl. No.: 10/123,380

(22) Filed: Apr. 16, 2002

(65) Prior Publication Data

US 2002/0149521 A1 Oct. 17, 2002

Related U.S. Application Data

(60) Provisional application No. 60/284,074, filed on Apr. 16, 2001.

(51) Int. Cl.[7] ..... H01Q 1/24; H01Q 9/42

(52) U.S. Cl. ..... 343/702; 343/749; 343/830

(58) Field of Search ..... 343/749, 806, 343/829, 830, 846, 702, 700 MS, 741, 742, 895

(56) References Cited

U.S. PATENT DOCUMENTS

| | | | | |
|---|---|---|---|---|
| 3,736,534 | A | | 5/1973 | Chaffee |
| 3,742,393 | A | | 6/1973 | Karp |
| 3,925,738 | A | | 12/1975 | Bates et al. |
| 4,435,689 | A | | 3/1984 | McDowell |
| 4,465,988 | A | | 8/1984 | Moats |
| 4,495,503 | A | | 1/1985 | Morman |
| 4,546,357 | A | | 10/1985 | Laughon et al. |
| 4,692,727 | A | | 9/1987 | Wakino et al. |
| 4,764,771 | A | | 8/1988 | Sterns |
| 4,847,625 | A | | 7/1989 | Dietrich et al. |
| 5,198,831 | A | * | 3/1993 | Burrell et al. ..... 343/895 |
| 5,313,216 | A | | 5/1994 | Wang et al. |
| 5,406,233 | A | | 4/1995 | Shih et al. |
| 5,497,164 | A | | 3/1996 | Croq |
| 5,504,466 | A | | 4/1996 | Chan-Son-Lint et al. |
| 5,566,441 | A | | 10/1996 | Marsh et al. |
| 5,680,144 | A | | 10/1997 | Sanad |
| 5,768,217 | A | | 6/1998 | Sonoda et al. |

(List continued on next page.)

OTHER PUBLICATIONS

Harrington, Roger F., Effect of Antenna Size on Gain, Bandwidth, and Efficiency, Journal of Research of the National Bureau of Standards—D. Radio Propagation, vol. 64D, No. 1, Jan.–Feb. 1960.

Harvey, A. F., Periodic and Guiding Structures at Microwave Frequencies, IRE Transactions on Microwave Theory and Techniques, Jan. 1960, pp. 30–61.

*Primary Examiner*—Michael C. Wimer
(74) *Attorney, Agent, or Firm*—John L. DeAngelis; Beusse Brownlee Wolter Mora & Maire P.A.

(57) ABSTRACT

There is disclosed a meanderline loaded antenna formed by applying a conductive ink or other conductive material to a flexible substrate. The substrate is then shaped by removing regions and folding other regions along perforated or scored lines to fit the antenna within the available space of a wireless device. In lieu of folding regions of a planar substrate to form a three-dimensional structure, the substrate can be vacuum formed over a mandrel after the antenna elements have been formed thereon. The antenna can also be formed by printing on existing enclosure surfaces of a wireless device or on the surfaces of components within the device. Thus the advantages offered by a meanderline antenna where the effective electrical length is greater than the actual physical length are achieved in conjunction with a space-saving physical structure for the antenna.

24 Claims, 3 Drawing Sheets

U.S. PATENT DOCUMENTS

| | | | | | |
|---|---|---|---|---|---|
| 5,790,080 | A | | 8/1998 | Apostolos | |
| 5,838,285 | A | * | 11/1998 | Tay et al. | 343/895 |
| 5,867,126 | A | | 2/1999 | Kawahata et al. | |
| 5,872,549 | A | * | 2/1999 | Huynh et al. | 343/895 |
| 5,874,919 | A | | 2/1999 | Rawnick et al. | |
| 5,896,113 | A | * | 4/1999 | O'Neill, Jr. | 343/895 |
| 5,936,587 | A | | 8/1999 | Gudilev et al. | |
| 5,973,598 | A | | 10/1999 | Beigel | |
| 5,995,006 | A | | 11/1999 | Walsh | |
| 6,005,525 | A | | 12/1999 | Kivela | |
| 6,016,122 | A | | 1/2000 | Malone et al. | |
| 6,094,170 | A | | 7/2000 | Peng | |
| 6,107,920 | A | | 8/2000 | Eberhardt et al. | |
| 6,124,831 | A | | 9/2000 | Rutkowski et al. | |
| 6,137,453 | A | | 10/2000 | Wang et al. | |
| 6,147,662 | A | | 11/2000 | Grabau et al. | |
| 6,166,694 | A | | 12/2000 | Ying | |
| 6,215,229 | B1 | | 4/2001 | Kuroda et al. | |
| 6,232,923 | B1 | | 5/2001 | Guinn et al. | |
| 6,252,550 | B1 | | 6/2001 | Vernon | |
| 6,259,369 | B1 | | 7/2001 | Monico | |
| 6,285,342 | B1 | | 9/2001 | Brady et al. | |
| 6,313,716 | B1 | | 11/2001 | Apostolos | |
| 6,320,509 | B1 | | 11/2001 | Brady et al. | |
| 6,323,814 | B1 | | 11/2001 | Apostolos | |
| 6,388,626 | B1 | * | 5/2002 | Gamalielsson et al. | 343/895 |
| 6,504,508 | B2 | | 1/2003 | Apostolos | |
| 2001/0002035 | A1 | | 5/2001 | Kayanakis | |
| 2001/0048394 | A1 | | 12/2001 | Apostolos | |

* cited by examiner

FABRICATION METHOD AND APPARATUS FOR ANTENNA STRUCTURES IN WIRELESS COMMUNICATIONS DEVICES

This patent application claims the benefit of the provisional application filed on Apr. 16, 2001, and bearing application No. 60/284,074.

FIELD OF THE INVENTION

This invention relates generally to antennas comprising slow wave structures, and especially to such antennas formed using conductive ink processes.

BACKGROUND OF THE INVENTION

It is generally known that antenna performance is dependent upon the size, shape and material composition of the constituent antenna elements, as well as the relationship between certain antenna physical parameters (e.g., length for a linear antenna and diameter for a loop antenna) and the wavelength of the signal received or transmitted by the antenna. These relationships determine several antenna operational parameters, including input impedance, gain, directivity and the radiation pattern. Generally for an operable antenna, the minimum physical antenna dimension (or the electrically effective minimum distance) must be on the order of a quarter wavelength (or a multiple thereof) of the operating frequency, which thereby advantageously limits the energy dissipated in resistive losses and maximizes the energy transmitted. Quarter wave length and half wave length antennas are the most commonly used.

The burgeoning growth of wireless communications devices and systems has created a substantial need for physically smaller, less obtrusive, and more efficient antennas that are capable of wide bandwidth or multiple frequency band operation, and/or operation in multiple modes (i.e., selectable radiation patterns or selectable signal polarizations). Smaller packaging of state-of-the-art communications devices does not provide sufficient space for the conventional quarter and half wave length antenna elements. As is known to those skilled in the art, there is a direct relationship between physical antenna size and antenna gain, at least with respect to a single-element antenna, according to the relationship: gain=(βR)^2+2βR, where R is the radius of the sphere containing the antenna and β is the propagation factor. Increased gain thus requires a physically larger antenna, while users continue to demand physically smaller antennas. As a further constraint, to simplify the system design and strive for minimum cost, equipment designers and system operators prefer to utilize antennas capable of efficient multi-frequency and/or wide bandwidth operation. Finally, gain is limited by the known relationship between the antenna frequency and the effective antenna length (expressed in wavelengths). That is, the antenna gain is constant for all quarter wavelength antennas of a specific geometry i.e., at that operating frequency where the effective antenna length is a quarter of a wavelength of the operating frequency.

One basic antenna commonly used in many applications today is the half-wavelength dipole antenna. The radiation pattern is the familiar donut shape with most of the energy radiated uniformly in the azimuth direction and little radiation in the elevation direction. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical gain is about 2.15 dBi.

The quarter-wavelength monopole antenna placed above a ground plane is derived from a half-wavelength dipole. The physical antenna length is a quarter-wavelength, but with the ground plane the antenna performance resembles that of a half-wavelength dipole. Thus, the radiation pattern for a monopole antenna above a ground plane is similar to the half-wavelength dipole pattern, with a typical gain of approximately 2 dBi.

The common free space (i.e., not above ground plane) loop antenna (with a diameter of approximately one-third the wavelength) also displays the familiar donut radiation pattern along the radial axis, with a gain of approximately 3.1 dBi. At 1900 MHz, this antenna has a diameter of about 2 inches. The typical loop antenna input impedance is 50 ohms, providing good matching characteristics.

The well-known patch antenna provides directional hemispherical coverage with a gain of approximately 4.7 dBi. Although small compared to a quarter or half wave length antenna, the patch antenna has a relatively narrow bandwidth.

Given the advantageous performance of quarter and half wavelength antennas, conventional antennas are typically constructed so that the antenna length is on the order of a quarter wavelength of the radiating frequency, and the antenna is operated over a ground plane. These dimensions allow the antenna to be easily excited and operated at or near a resonant frequency, limiting the energy dissipated in resistive losses and maximizing the transmitted energy. But, as the operational frequency increases/decreases, the operational wavelength decreases/increases and the antenna element dimensions proportionally decrease/increase.

Thus antenna designers have turned to the use of so-called slow wave structures where the structure physical dimensions are not equal to the effective electrical dimensions. Recall that the effective antenna dimensions should be on the order of a half wavelength (or a quarter wavelength above a ground plane) to achieve the beneficial radiating and low loss properties discussed above. Generally, a slow-wave structure is defined as one in which the phase velocity of the traveling wave is less than the free space velocity of light. The wave velocity is the product of the wavelength and the frequency and takes into account the material permittivity and permeability, i.e., $c/((\mathrm{sqrt}(\epsilon_r)\mathrm{sqrt}(\mu_r))=\lambda f$. Since the frequency remains unchanged during propagation through a slow wave structure, if the wave travels slower (i.e., the phase velocity is lower) than the speed of light, the wavelength within the structure is lower than the free space wavelength. Thus, for example, a half wavelength slow wave structure is shorter than a half wavelength structure where the wave propagates at the speed of light (c). The slow-wave structure de-couples the conventional relationship between physical length, resonant frequency and wavelength. Slow wave structures can be used as antenna elements (i.e., feeds) or as antenna radiating structures.

Since the phase velocity of a wave propagating in a slow-wave structure is less than the free space velocity of light, the effective electrical length of these structures is greater than the effective electrical length of a structure propagating a wave at the speed of light. The resulting resonant frequency for the slow-wave structure is correspondingly increased. Thus if two structures are to operate at the same resonant frequency, as a half-wave dipole, for instance, then the structure propagating the slow wave will be physically smaller than the structure propagating the wave at the speed of light.

Slow wave structures are discussed extensively by A. F. Harvey in his paper entitled *Periodic and Guiding Structures*

*at Microwave Frequencies*, in the IRE Transactions on Microwave Theory and Techniques, January 1960, pp. 30–61 and in the book entitled *Electromagnetic Slow Wave Systems* by R. M. Bevensee published by John Wiley and Sons, copyright 1964. Both of these references are incorporated by reference herein.

A transmission line or conductive surface on a dielectric substrate exhibits slow-wave characteristics, such that the effective electrical length of the slow-wave structure is greater than its actual physical length, according to the equation, $$l_e=(\epsilon_{eff}^{1/2})xl_p,$$

where $l_e$ is the effective electrical length, $l_p$ is the actual physical length, and $\epsilon_{eff}$ is the dielectric constant ($\epsilon_r$) of the dielectric material proximate the transmission line.

A prior art meanderline, which is one example of a slow wave structure, comprises a conductive pattern (i.e., a traveling wave structure) over a dielectric substrate, overlying a conductive ground plane. An antenna employing a meanderline structure, referred to as a meanderline-loaded antenna or a variable impedance transmission line (VITL) antenna, is disclosed in U.S. Pat. No. 5,790,080. The antenna consists of two vertical spaced apart conductors and a horizontal conductor disposed therebetween, with a gap separating each vertical conductor from the horizontal conductor.

The antenna further comprises one or more meanderline variable impedance transmission lines bridging the gap between the vertical conductor and each horizontal conductor. Each meanderline coupler is a slow wave transmission line structure carrying a traveling wave at a velocity lower than the free space velocity. Thus the effective electrical length of the slow wave structure is greater than its actual physical length. Consequently, smaller antenna elements can be employed to form an antenna having, for example, quarter-wavelength properties. As for all antenna structures, the antenna resonant condition is determined by the electrical length of the meanderlines plus the electrical length of the radiating elements.

Although the meanderline antenna described above is relatively narrowband in operation, one technique for achieving broadband operation provides for electrically shortening the meanderlines to change the resonant antenna frequency. In such an embodiment the slow-wave meanderline structure includes separate switchable segments (controlled, for example, by vacuum relays, MEMS (micro-electro-mechanical systems), PIN diodes or mechanical switches) that can be inserted in and removed from the circuit by action of the associated switch. This switching action changes the effective electrical length of the meanderline coupler and thus changes the effective length of the antenna and its resonant characteristics. Losses are minimized in the switching process by placing the switching structure in the high impedance sections of the meanderline. Thus the current through the switching device is low, resulting in very low dissipation losses and a high antenna efficiency.

In lieu of removing and adding meanderline segments to the antenna by switching devices as described above, the antenna can be constructed with multiple selectable meanderlines to control the effective antenna electrical length. These are also switched into and removed from the antenna using the switching devices described above.

The meanderline-loaded antenna allows the physical antenna dimensions to be reduced, while maintaining an effective electrical length that, in one embodiment, is a quarter wavelength multiple. The meanderline-loaded antennas operate in the region where the performance is limited by the Chu-Harrington relation, that is, efficiency=FVQ, where: Q=quality factor V=volume of the structure in cubic wavelengths F=geometric form factor (F=64 for a cube or a sphere)

Meanderline-loaded antennas achieve this efficiency limit of the Chu-Harrington relation while allowing the effective antenna length to be less than a quarter wavelength at the resonant frequency. Dimension reductions of 10 to 1 can be achieved over a quarter wavelength monopole antenna, while achieving a comparable gain.

It is known to utilize printed circuit board processing techniques to fabricate antenna structures, including, for example, patch antennas, dipoles, spirals, antennas loaded with impedance elements, and fractal antennas. These circuit board processes involve multiple complex steps, including developing the artwork for the antenna, photoresist coating of the circuit board, exposing and developing the board, etching the exposed areas, washing the board and finally overplating the exposed regions to form the antenna structures. Given the costs associated with the individual fabrication steps, the total antenna cost can be considerable. Further, these printed circuit antennas occupy considerable space within the device and are not easily conformable to the device envelope.

BRIEF SUMMARY OF THE INVENTION

A meanderline antenna such as described above, offers desirable attributes within a smaller physical volume than prior art antennas, while exhibiting comparable or enhanced performance over conventional antennas. To gain additional benefits from the use of these meanderline antennas, it is advantageous to minimize the space occupied by the antenna and further to provide the antenna at a lower cost through the use of more efficient antenna construction techniques.

Thus the present invention forms an antenna by printing conductive ink, paint, toner or paste on a substrate to form the various antenna elements, including the meanderline elements. The term "printing" is intended to connote any fabrication process for forming, depositing, or otherwise laying down a path of conductive material. The conductive material can be applied to both rigid and flexible substrates and exhibits relatively high conductivity when applied in thin layers. When operative in conjunction with a wireless device, an antenna constructed according to the teachings of the present invention can be made conformable to the surfaces of and the available space within the wireless device. The antenna also provides the other beneficial attributes of a meanderline antenna as described above. Construction of a meanderline antenna according to the present invention avoids the multi-step metal folding processes and captivation hardware for securing the elements of the prior art meanderline antenna in place, while offering the beneficial performance of meanderline antenna technology.

The conductive ink printing process according to the present invention can be advantageously applied to existing structures within or the enclosure of the wireless device. Thus an antenna formed by the printing of conductive material conforms to the shape of existing elements of the device, consuming little additional space within the device. In one embodiment, for example, the antenna elements are printed on the surface of an integrated circuit within the device.

Further, multiple layers comprising individual antennas or individual antenna elements (for example, meanderlines)

can be formed on multiple substrate layers, and interconnected to provide conductive paths for the radio frequency signals.

BRIEF DESCRIPTION OF THE DRAWINGS

The present invention can be more easily understood in the further advantages and used there are more readily apparent, when considered in view of the description of the preferred embodiments and the following figures in which.

DETAILED DESCRIPTION OF THE INVENTION

Figure 1:
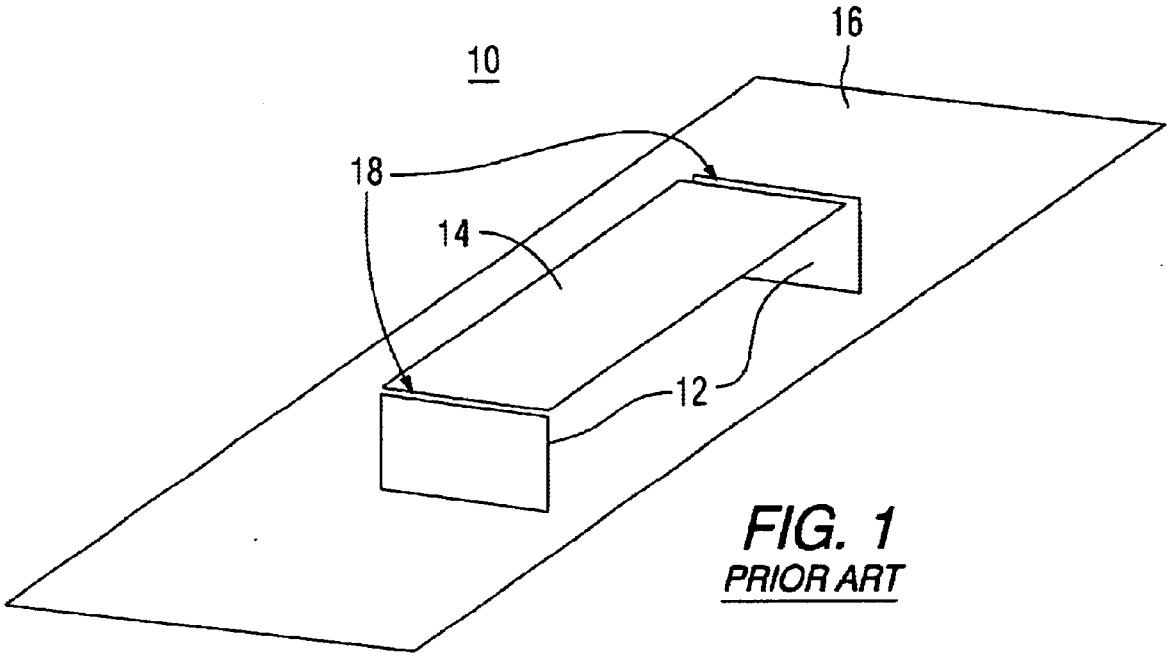
FIG. 1 PRIOR ART
FIG. 1 is a perspective view of the meanderline-loaded antenna of the prior art.

Before describing in detail the particular meanderline-loaded antenna constructed according to the teachings of the present invention, it should be observed that the present invention resides primarily in a novel and non-obvious combination of method steps and elements related to antennas structures and antenna technology in general. Accordingly, the hardware components and method steps described herein have been represented by conventional elements in the drawings and in the specification description, showing only those specific details that are pertinent to the present invention, so as not to obscure the disclosure with details that will be readily apparent to those skilled in the art having the benefit of the description herein.

FIG. 1 depicts a perspective view of a prior art meanderline-loaded antenna 10 (also referred to as a variable impedance transmission line antenna) to which the teachings of the present invention can be advantageously applied. The meanderline-loaded antenna 10 includes two vertical conductors 12, a horizontal conductor 14, and a ground plane 16. The vertical conductors 12 are physically separated from the horizontal conductor 14 by gaps 18, but are electrically connected to the horizontal conductor 14 by two meanderline couplers, (not shown) one for each of the two gaps 18, to thereby form an antenna structure capable of radiating and receiving RF (radio frequency) energy. See U.S. Pat. No. 5,790,080, which is hereby incorporated by reference, for additional details.

Figure 2:
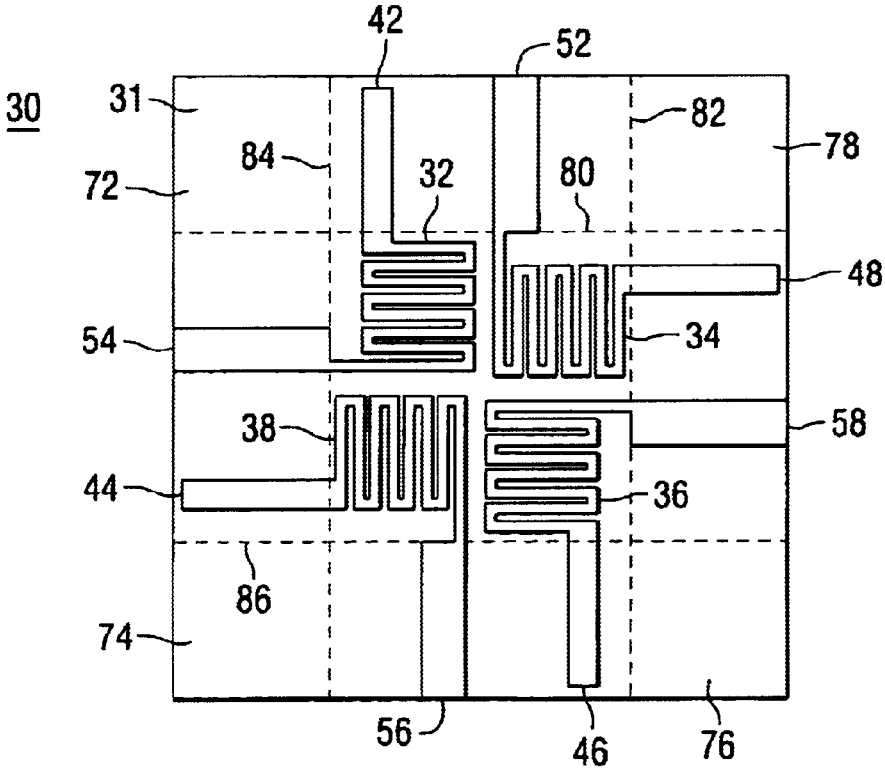
FIG. 2 illustrates a printed antenna according to the teachings of the present invention.

FIG. 2 is a planar view of a meanderline antenna 30 formed on a substrate 31 according to the teachings of the present invention. The substrate 31 comprises Mylar® material, Kapton® material or another flexible material that can be shapcd to conform to the available space within the wireless device. The substrate 31 can also comprise a web-type material. In one embodiment the substrate 31 comprises polyester having a thickness of about 0.005 inches. The antenna 30 comprises four meanderline segments 32, 34, 36 and 38 disposed between radiating/receiving segments 42, 44, 46 and 48 and signal input segments (i.e., in the transmit mode) 52, 54, 56 arid 58. In the receive mode the segments 52, 54, 56 and 58 serve as the output terminal of the antenna, providing the received signal to processing circuitry not shown in FIG. 2.

Figure 3:
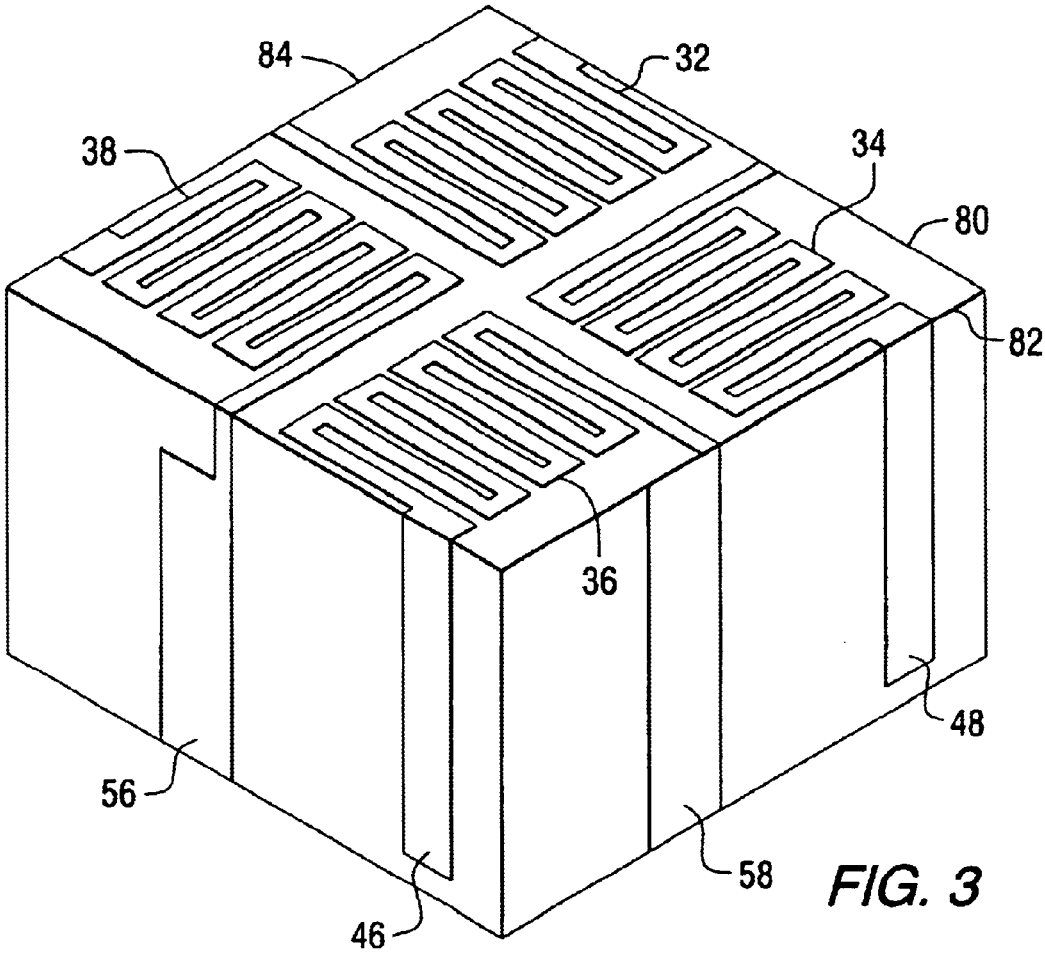
FIG. 3 illustrates the antenna of FIG. 2 after reconfiguring into a three-dimensional structure.

In a preferred embodiment, after printing the elements illustrated in FIG. 2, regions 72, 74, 76 and 78 are removed and the substrate 31 is folded along previously scored or perforated lines 80, 82, 84 and 86. The surfaces carrying the radiating/receiving segments 42, 44, 46 and 48 and signal input segments 52, 54, 56 and 58 are folded out of the plane of the meanderline segments 32, 34, 36 and 38 to form the four vertical surfaces of a cube. The meanderlines 32, 34, 36 and 38 are located on the top surface of the cube. The cubical form of the antenna 30 is illustrated in FIG. 3. The antenna radiates primarily from the four vertical surfaces of the cube, since the radiating/receiving elements 42, 44, 46 and 48 are located on those surfaces. In one embodiment each cube side is about 1.2 inches square. In this embodiment the antenna 30 operates within a frequency band of about 800 MHz to 2500 MHz. In other embodiments any polyhedron shape can be formed by repositioning the various elements in FIG. 2. Thus the antenna can be configured to fit within the available volume and the elements can sized to produce the desired resonant frequency and bandwidth.

In another embodiment the substrate 31 comprises polyimide, polycarbonate or polyester (or another thermoplastic material) that can be shaped by vacuum forming, in lieu of scoring and folding along certain lines. Thus the substrate 31 can be vacuum formed over a cubical mandrel, such that one radiating/receiving element is disposed on each of the four vertically-oriented surfaces of the cube. Other three-dimensional shapes can be formed by appropriately positioning the antenna elements and using the desired mandrel shape.

In one operational embodiment, the four signal input segments are responsive to the same signal for transmission by the four radiating/receiving elements 42, 44, 46 and 48. In another embodiment, the input signals can be phased with respect to each other (by passing one or more of the signals through a phase shifting device, for example), to produce a desired composite antenna radiation pattern. Changing the relative phase angles of the input signals steers the radiation beam and can also shape the resulting antenna beam.

Conductive inks for printing the elements of FIG. 1 are known in the art and typically include either carbon or silver particles to provide the conductive properties, although other conductive particles are suitable. Known application methods comprise screen printing, stencils, silk screening, bubble-jet printing and the use of conductive toner.

Figure 4:
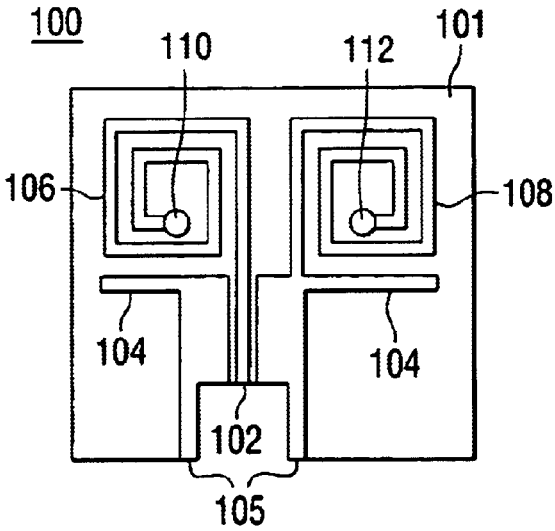
FIGS. 4 and 5 illustrate both sides of a substrate material carrying a printed ink antenna according to the teachings of the present invention.

FIG. 4 illustrates a meanderline antenna 100 that is a printed version of the meanderline-loaded antenna 10 of FIG. 1, formed from printed conductive ink on a substrate 101. In one embodiment the substrate is polyester about 0.010 inches thick. The antenna 100 comprises a signal terminal 102 operative in the receive mode to provide the signal received by the antenna 100 to receiver circuitry, and in the transmit mode responsive to the signal to be transmitted. The antenna 100 further comprises a ground plane 104, ground terminals 105 and meanderlines 106 and 108.

Figure 5:
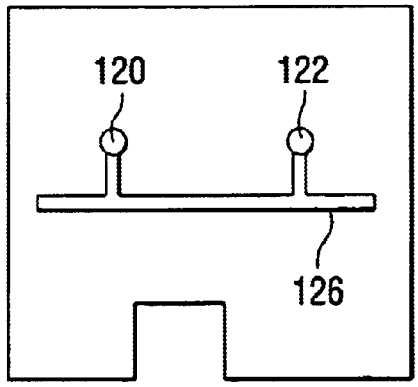

In one embodiment, the elements of the antenna 100 are printed on the substrate 101 using a silver conductive ink. Conductive holes 110 and 112, are solid conductive plugs formed by filling open vias with conductive ink for connecting a terminal end of the meanderlines 106 and 108, respectively, to terminals 120 and 122 of a radiating/receiving element 126 formed on the top surface of the substrate 101, as illustrated in FIG. 5. A radio frequency connector, not shown, includes a feed pin electrically connected to the signal conductor 102 and a grounded terminal electrically connected to the ground terminals 105, for connecting the antenna 100 to signal processing circuitry of the wireless device.

In one embodiment, the antenna 100 is formed on a substrate 101 about 1.25 inches square and operates in the personal communications services (PCS) band of 1850 MHz to 1990 MHz. Other embodiments with different structural dimensions operate in other frequency bands.

The substrate 101 comprises a thin flexible material such as Mylar® material, Kapton® material, polyethyline, polyvinyl chloride, polyester, polycarbonate, polystyrene or another plastic type material that can accept conductive ink, paste, toner or paint according to the techniques described herein. Farther, the use of a flexible substrate material allows the form factor of the antenna 100 to conform to the available space envelope in the wireless device. Thus, although the antenna 100 is illustrated as printed on a separate substrate 101, it can be formed on an existing surface of a wireless device, such as the interior surface of the case or shell of the device. In another embodiment the antenna 100 can be formed on a functional electronic component of the device, such as a surface of an integrated circuit. In yet another embodiment, one surface of the substrate 101 comprises an interior surface of the device enclosure and the other surface comprises the opposing exterior surface of the device enclosure. Accordingly, the radiating/receiving element 126 is located on the outside surface, and a protective layer will typically be required to protect the radiating/receiving element 126 from damage during use. The use of a conformable material and the ability to print the antenna on a substrate as taught by the present invention, provides substantial reduction in the interior space required for the antenna and significant flexibility in locating the antenna during the design phase of the wireless device.

In another embodiment of the present invention, one or more printable switches can be included within the meanderlines 106 and 108 (or the meanderline segments 32, 34, 36 and 38 of FIGS. 2 and 3) to change the meanderline length and thus the resonant frequency of the antenna 100 (or the antenna 30). Also, each of the antennas 30 and 100 can be formed with multiple selectable meanderlines also for the purpose of modifying the antenna resonant frequency and other characteristics. These meanderlines can be formed in the same layer of the substrate 31 or 101 or formed in different layers and suitably insulated.

There are several processes that can be employed to form the various antennas and their constituent elements described above. The conductive ink can be a liquid or a paste material that is applied in the desired shape or pattern to the substrate. Typically, the ink thickness is less than about two to four thousandths. The ink includes a crystalline material suspended in a solvent that crystallizes to a surface, such as the substrate 31 and 101, as the solvent evaporates. In conductive ink the crystalline material is a conductive component such as silver, another precious metal, copper, gold, platinum, nickel, aluminum, graphite, carbon, carbon/silver blend, and silver/silver chloride in the form of particles or flakes. The density of the crystalline material must be sufficiently high to provide a suitably low resistance for the antenna structures. Depending on the embodiment and the application, it may also be necessary for the conductive ink to exhibit certain flexing properties so that the elements will remain intact when the substrate is shaped as desired, as the antenna 30 is shaped according to the FIG. 3 embodiment. Conductive tape, foil and toner can also be used to form the antenna elements, employing suitable methods know in the art to form the antenna structures on a suitable substrate.

To improve manufacturing efficiency, a plurality of antennas and their constituent elements can be formed on a large sheet of substrate material then singulated using a suitable tool into individual antennas.

A number of different methods can be employed to apply the conductive material, and the best method may be dependent on the selected conductive and substrate materials. The various methods include, but are not limited to, silk screening, stenciling, spraying or conventional lithography. If the antenna structural elements are defined by a mask or stencil, the conductive ink is typically applied by squeegeeing onto the substrate such that the conductive ink is applied only in the open areas. Use of a bubble jet process does not require the use of masks or stencils, as application of the ink is controlled by an image of the conductive areas.

Certain embodiments according to the present invention have elements on both sides of the substrate. In these embodiments holes are formed in the substrate, by laser drilling, for example, prior to application of the ink. Conductive ink is then squeegeed through the holes to form a conductive plug within each hole. Both surfaces of the substrate are printed and the conductive holes provide the interconnection between the conductive elements on the opposing surfaces.

Multiple layers of conductive material, with intervening dielectric layers, formed from a dielectric ink or polymer, can be used to create desired multi-layer antenna structures. Openings formed in the dielectric layers allow for the formation of conductive plugs to interconnect conductive layers. The conductive layers can also rely on capacitive coupling in lieu of a physical connection.

In yet another embodiment of the present invention, the substrate undergoes electroplating after the conductive material is applied, using the conductive material as an electrode for the electroplating step. As is known, the conductive material applied by painting, silk-screening, etc. as described above, results in the formation of an amorphous conductive path with interstitial spaces that reduce the conductivity. Electroplating another conductive material thereover forms a crystalline conductive path that exhibits a higher conductivity than the amorphous material. Also, multiple amorphous layers, rather than an electroplated layer, can be employed to increase the conductivity.

Substrate materials suitable for use with the various embodiments of the present invention include, but are not limited to: Mylar® material. Kapton® material polyimide, polyester, polycarbonate, polyvinyl chloride, polyothyline, polystyrene, web-like material and other non-conducting materials that exhibit flexing and/or formable properties.

Typically, an antenna constructed according to the teachings of the present invention is used with wireless devices operating at ultra-high frequencies (UHF) or higher. At these frequencies, current flowing through a conductor is restricted to the regions near the conductor surface, due to the phenomenon know as the "skin effect." Because the current is confined to a smaller conductor cross-section, the skin effect raises the conductor resistance, therefore increasing resistive losses due to conductor heating (i.e., the $I^2R$ losses). To counteract the skin effect and lower the resistance at higher frequencies, the conductor cross sectional area must be increased. The use of conductive ink to form the antenna elements allows for a reduction in the skin effect by increasing the footprint of the conductor, i.e., applying the ink over a larger surface area, which in turn raises the conductor cross-section and decreases the resistive losses. In contrast, according to the prior art antenna structures, increasing the conductor cross-sectional area requires the conductor to occupy a larger physical volume, thus increasing the size of the antenna and the wireless device with which it operates.

Figure 6:
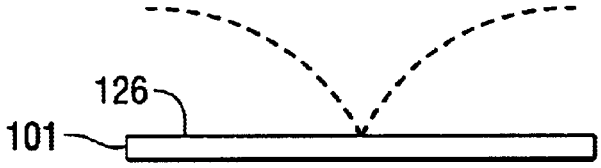
FIGS. 6 through 9 illustrate exemplary operational modes for an antenna constructed according to the teachings of the present invention.
Figure 7:
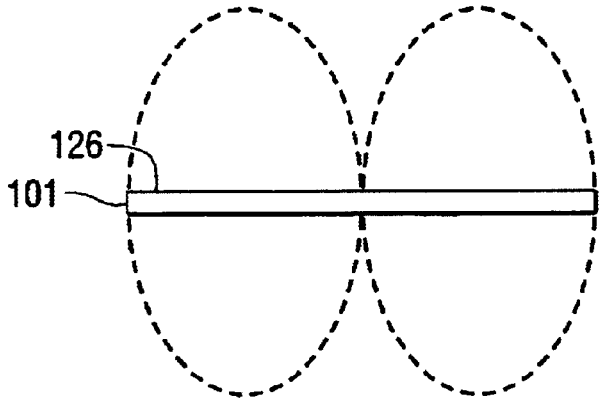

Turning to FIGS. 6 and 7, there is shown (with dashed lines) the current distribution (FIG. 6) and the antenna electric field radiation pattern (FIG. 7) for the antenna 100 operating in a monopole or half wavelength mode (i.e., the effective electrical length of the antenna elements is about one-half of a wavelength) as driven by an input signal source not shown. Thus, in this mode the total effective electrical length of the meanderlines 106 and 108 and the radiating/receiving element 126 is chosen such that the horizontal conductor radiating/receiving element 126 has a current null near the center and current maxima at each edge. The resulting electric field pattern has the familiar omnidirectional donut shape as shown in FIG. 7. The dimensions, geometry and material of one or more of the antenna components (the meanderlines 106 and 108, the ground plane 104, the substrate 101 and the radiating/receiving element 126) can be modified by the antenna designer to create an antenna having different antenna characteristics at other frequencies or frequency bands.

Figure 8:
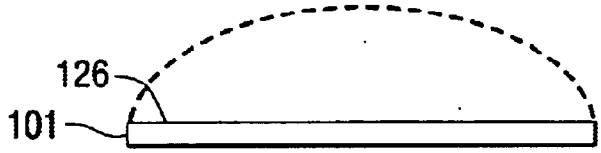
Figure 9:
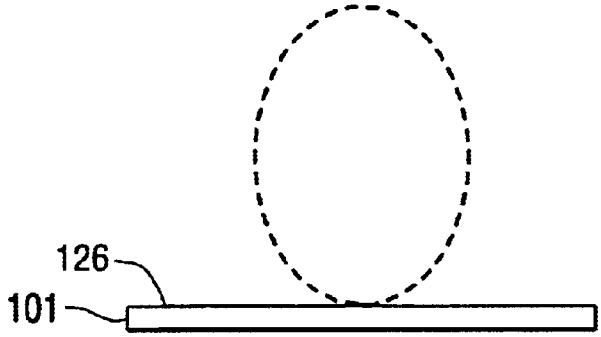

A second exemplary operational mode for the meanderline-loaded antenna 100 is illustrated in FIGS. 8 and 9. This mode is the so-called loop mode, operative when the ground plane 104 is electrically large compared to the effective length of the antenna and wherein the electrical length is about one wavelength at the operating frequency. In this mode the current maximum occurs approximately at the center of the radiating/receiving element 126 (see FIG. 8) producing an electric field radiation pattern as illustrated in FIG. 9.

The antenna characteristics displayed in FIGS. 8 and 9 are based on an antenna of twice the effective electrical length as the antenna depicted in FIGS. 6 and 7. An antenna incorporating meanderlines as taught by the present invention can be designed to operate in either of the modes described above.

By changing the geometrical features of the antenna constructed according to the teachings of the present invention, the antenna can be made operative in other frequency bands, including the FCC-designated ISM (Industrial, Scientific and Medical) band of 2400 to 2497 MHz.

As is known by those skilled in the art, the various antenna embodiments constructed according to the teachings of the present invention can be used in an antenna array to achieve improved performance characteristics.

While the invention has been described with reference to preferred embodiments, it will be understood by those skilled in the art that various changes may be made and equivalent elements may be substituted for elements thereof without departing from the scope of the present invention. In addition, modifications may be made to adapt a particular situation more material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An antenna comprising:

a non-conducting substrate in the shape of a polyhedron comprising a plurality of faces;

a plurality of radiating/receiving pads disposed on one or more of said plurality of faces;

a plurality of feed pads equal in number to said plurality of radiating/receiving pads and disposed on one or more of said plurality of faces, wherein signals to be transmitted by the antenna are supplied to one or more of said plurality of feed pads and signals received by the antenna are supplied from one or more of said plurality of feed pads;

a plurality of meanderline elements equal in number to said plurality of radiating/receiving pads, wherein each one of said plurality of meanderline elements is electrically interposed between one of said plurality of radiating/receiving pads and one of said plurality of feed pads, and wherein each one of said plurality of meanderline elements is disposed on a different face from said plurality of radiating/receiving pads and said plurality of feed pads; and wherein each one of said plurality of meanderline elements has an effective electrical length greater than the physical length thereof.

2. The antenna of claim 1 wherein each one of the plurality of radiating/receiving pads, each one of the plurality of feed pads, and each one of the plurality of meanderline elements are formed on the substrate when the substrate is in a planar shape, and wherein the substrate is formable into the polyhedron, and wherein one or mote of the plurality of meanderline elements are formed on a first surface of the polyhedron, and one or more of the plurality of radiating/receiving pads and one or more of the plurality of feed pads are formed on a second surface of the polyhedron.

3. The antenna of claim 2 wherein the antenna is formable into the polyhedron by folding regions of the substrate with respect to other regions of the substrate.

4. The antenna of claim 1 wherein the material of the substrate is a thermoplastic material, and wherein the plurality of radiating/receiving pads, the plurality of feed pads, and the plurality of meanderline elements are formed on the substrate when the substrate is in a planar shape, and wherein the substrate is later formed into the polyhedron by thermoshaping over a mandrel having a desired polyhedron shape.

5. The antenna of claim 1 wherein each one of the plurality of meanderline elements is a slow wave structure, and wherein the plurality of faces comprises a top face and four side faces, and wherein the plurality of meanderline elements are disposed on said top face and one of the plurality of radiating/receiving pads and one of the plurality of feed pads is disposed on each side face.

6. The antenna of claim 1 wherein the plurality of radiating/receiving pads, the plurality of feed pads, and the plurality of meanderline elements are formed by printing conductive material on the substrate.

7. The antenna of claim 6 wherein the conductive material is selected from among conductive ink, conductive paint, conductive paste, and conductive toner.

8. The antenna of claim 6 wherein the conductive material comprises conductive particles selected from among silver, precious metals, copper, gold, platinum, nickel, aluminum, graphite, carbon, carbon/silver blend, and silver/silver chloride.

9. The antenna of claim 8 wherein the conductive particles comprise conductive flakes.

10. The antenna of claim 1 wherein the material of the substrate is selected from among Mylar® material, Kapton® material, polyimide, polyethyline, polyvinyl chloride, polyester, polycarbonate, polystyrene and plastic.

11. The antenna of claim 1 wherein the antenna is operated in conjunction with a wireless device for transmitting and/or receiving electromagnetic signals, and wherein the wireless device comprises electronic circuit elements housed within an enclosure, and wherein the substrate is selected from among an interior surface of the enclosure or a surface of an electronic circuit element.

12. The antenna of claim 11 wherein the plurality of radiating/receiving pads, the plurality of feed pads, and the plurality of meanderline elements are formed on the substrate when the substrate is in a planar shape, and wherein the substrate is later formed into the polyhedron to fit within the enclosure.

13. The antenna of claim 1 wherein the antenna is operated in conjunction with a wireless device for transmitting and/or receiving electromagnetic signals, and wherein the wireless device comprises electronic circuit elements housed within an enclosure, and wherein the substrate is an interior surface of the enclosure, such that the antenna is formed on an interior surface of the enclosure.

14. The antenna of claim 1 wherein the substrate comprises a multi-layer substrate, and wherein one or more radiating/receiving elements are formed on one or more layers of said multi-layer substrate.

15. The antenna of claim 1 wherein the substrate comprises a multi-layer substrate, and one or more meanderline elements are formed on one or more layers of said multi-layer substrate.

16. An antenna having a polyhedron shape having a plurality of surfaces, comprising:

a non-conducting substrate in the polyhedron shape;

a plurality of meanderline elements disposed on at least one surface of said substrate;

a like plurality of radiating/receiving elements disposed on one at least one surface of said substrate, wherein each one of said plurality of radiating/receiving elements is connected to one of said plurality of meanderline elements;

a like plurality of feed elements formed on at least one surface of said substrate, wherein each one of the plurality of feed elements is responsive to a different input signal for transmitting by the antenna, and wherein said plurality of meanderline elements are disposed on one surface of said substrate and at least one of said plurality of radiating/receiving elements and said plurality of feed elements are disposed on another surface of said substrate;

wherein each one of the plurality of meanderline elements is connected between one of the plurality of radiating/receiving elements and one of the plurality of feed elements.

17. The antenna of claim 16 wherein each one of the plurality of meanderline elements is responsive to differently phased versions of an input signal provided to each one of the plurality of feed elements when the antenna is operative in a transmit mode.

18. An antenna having a three dimensional shape having a plurality of surfaces, comprising:

a non-conducting substrate in the three dimensional shape;

a plurality of meanderline elements disposed on at least one surface of said substrate;

a like plurality of radiating/receiving elements disposed on one at least one surface of said substrate, wherein each one of said plurality of radiating/receiving elements is connected to one of said plurality of meanderline elements;

a like plurality of feed elements formed on at least one surface of said substrate, wherein each one of the plurality of feed elements is responsive to a different input signal for transmitting by the antenna;

wherein each one of the plurality of meanderline elements is connected between one of the plurality of radiating/receiving elements and one of the plurality of feed elements, wherein the substrate is in the shape of a cube, and wherein the plurality of meanderline elements comprises four meanderline elements disposed on a top surface of the cube, and wherein the plurality of radiating/receiving elements comprises four radiating/receiving dements, and wherein each one of the four radiating/receiving elements is disposed on a side surface of the cube, and wherein the plurality of feed elements comprises four feed elements, and wherein each one of the four feed elements is disposed on a side surface of the cube.

19. An antenna having a three dimensional shape having a plurality of surfaces, comprising:

a non-conducting substrate in the three dimensional shape;

a plurality of meanderline elements disposed on at least one surface of said substrate;

a like plurality of radiating/receiving elements disposed on one at least one surface of said substrate, wherein each one of said plurality of radiating/receiving elements is connected to one of said plurality of meanderline elements;

a like plurality of feed elements formed on at least one surface of said substrate, wherein each one of the plurality of feed elements is responsive to a different input signal for transmitting by the antenna;

wherein each one of the plurality of meanderline elements is connected between one of the plurality of radiating/receiving elements and one of the plurality of feed elements, wherein the substrate is in the shape of a cube, and wherein die plurality of meanderline elements comprises four meanderline elements disposed on a top surface of the cube, and wherein the plurality of radiating/receiving elements comprises four radiating/receiving elements, and wherein each one of the four radiating/receiving elements is disposed on a side surface of the cube, and wherein the plurality of feed elements comprises four feed elements, and wherein each one of the four feed elements is disposed on a side surface of the cube wherein the four radiating/receiving elements, the four feed elements and the four meanderline elements are formed on the substrate when the substrate is in a substantially planar configuration, and wherein the four corner regions of the substrate are removed and the substrate is then folded into said cube.

20. An antenna comprising:

a non-conducting substrate having first and second surfaces;

at least two spiral-shaped meanderline elements disposed on the first surface of said substrate;

a radiating/receiving element disposed on the second surface of said substrate and having first and second terminals;

wherein an inner terminal of at least a first one of said at least two meanderline elements is electrically connected to said first terminal of said radiating/receiving element by a first conductive plug passing through said substrate; and wherein an inner terminal of at least a second one of said at least two meanderline elements is electrically connected to said second terminal of said radiating/receiving element by a second conductive plug passing through said substrate.

21. The antenna of claim 20 wherein the at least two meanderline elements comprise a first and a second meanderline element, and wherein an outer terminal of the first meanderline element is responsive to a signal when the antenna is operating in a transmit mode and provides a signal when the antenna is operating in a receive mode.

22. The antenna of claim 21 further comprising a ground plane disposed on the first surface of the substrate, wherein an outer terminal of the second meanderline element is connected to said ground plane.

23. The antenna of claim 20 wherein the substrate is formable after the at least two meanderline elements and the radiating/receiving element have been formed thereon.

24. The antenna of claim 20 wherein the at least two meanderline elements and the radiating/receiving element are formed by printing conductive material on the substrate.

* * * * *